US012677884B2

(12) United States Patent
Carmichael et al.

(10) Patent No.: US 12,677,884 B2
(45) Date of Patent: Jul. 14, 2026

(54) SLEEVE FOR SMOKING ARTICLE

(71) Applicant: RAI Strategic Holdings, Inc., Winston-Salem, NC (US)

(72) Inventors: Misti Jones Carmichael, Clemmons, NC (US); Stephen Benson Sears, Siler City, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 864 days.

(21) Appl. No.: 17/119,293

(22) Filed: Dec. 11, 2020

(65) Prior Publication Data

US 2022/0183389 A1 Jun. 16, 2022

(51) Int. Cl.
*A24F 40/57* (2020.01)
*A24F 40/10* (2020.01)
(Continued)

(52) U.S. Cl.
CPC ..... *A24F 40/57* (2020.01); *A24F 40/10* (2020.01); *A24F 40/20* (2020.01); *A24F 40/46* (2020.01);
(Continued)

(58) Field of Classification Search
CPC ..... A24F 40/00; A24F 40/10; A24F 40/20; A24F 40/40; A24F 40/46; A24F 40/48;
(Continued)

(56) References Cited

U.S. PATENT DOCUMENTS 2,233,288 A * 2/1941 Modine ..... 131/198
4,639,368 A 1/1987 Niazi et al.
(Continued)

FOREIGN PATENT DOCUMENTS

EP 3491945 6/2019
JP 2020188729 A 11/2020
(Continued)

OTHER PUBLICATIONS

*Chemical and Biological Studies on New Cigarette Prototypes that Heat Instead of Burn Tobacco,* R. J. Reynolds Tobacco Company Monograph (1988).
Leffingwell et al., "Tobacco Flavoring for Smoking Products", *R. J. Reynolds Tobacco Company,* 1972, pp. 1-72.
Notice of Reasons for Rejection issued Nov. 4, 2025, in corresponding Japanese Patent Application No. 2023-535408.
(Continued)

*Primary Examiner* — Michael H. Wilson
*Assistant Examiner* — Daniel Edward Vakili
(74) *Attorney, Agent, or Firm* — Womble Bond Dickinson (US) LLP

(57) ABSTRACT

The present disclosure provides temperature regulating sleeves for use with smoking articles. In some embodiments, temperature regulating sleeves may include various components including an outer shell, an inner chamber at least partially defined within the outer shell and configured to receive at least a portion of a smoking article, an opening through the outer shell configured for egress of an aerosol therethrough, a power source positioned within the outer shell, at least one control component positioned within the outer shell, one or more sensors positioned in communication with the inner chamber, and one or more ventilation components positioned in communication with the inner chamber. In some embodiments, temperature regulating sleeves according to the disclosure may be capable of effecting an automatic adjustment of at least a temperature of at least a portion of a smoking article used therewith.

20 Claims, 4 Drawing Sheets

(51) Int. Cl.

| | |
|---|---|
| ***A24F 40/20*** | (2020.01) |
| ***A24F 40/46*** | (2020.01) |
| ***A24F 40/48*** | (2020.01) |
| ***A24F 40/51*** | (2020.01) |
| ***A24F 40/60*** | (2020.01) |

(52) U.S. Cl.
CPC ..... *A24F 40/48* (2020.01); *A24F 40/51* (2020.01); *A24F 40/60* (2020.01)

(58) Field of Classification Search
CPC ..... A24F 40/50; A24F 40/51; A24F 40/57; A24F 40/60
See application file for complete search history.

(56) References Cited

U.S. PATENT DOCUMENTS 4,674,519 A 6/1987 Kertitsis et al.
4,735,217 A 4/1988 Gerth et al.
4,793,365 A 12/1988 Sensabaugh et al.
4,807,809 A 2/1989 Pryor et al.
4,836,224 A 6/1989 Lawson et al.
4,889,143 A 12/1989 Pryir et al.
4,922,901 A 5/1990 Brooks et al.
4,924,887 A 5/1990 Raker et al.
4,924,888 A 5/1990 Perfetti et al.
4,941,484 A 7/1990 Clapp et al.
4,947,874 A 8/1990 Brooks et al.
4,972,854 A 11/1990 Kiernan et al.
4,987,906 A 1/1991 Young et al.
5,025,814 A 6/1991 Raker et al.
5,056,537 A 10/1991 Brown et al.
5,060,671 A 10/1991 Counts et al.
5,093,894 A 3/1992 Deevi et al.
5,099,864 A 3/1992 Young et al.
5,101,839 A 4/1992 Jakob et al.
5,143,097 A 9/1992 Sohn et al.
5,154,192 A 10/1992 Sprinkel et al.
5,159,942 A 11/1992 Brinkley et al.
5,178,878 A 1/1993 Wehling et al.
5,220,930 A 6/1993 Gentry
5,223,264 A 6/1993 Wehling et al.
5,224,498 A 7/1993 Deevi et al.
5,228,460 A 7/1993 Sprinkel, Jr. et al.
5,249,586 A 10/1993 Morgan et al.
5,261,424 A 11/1993 Sprinkel, Jr. et al.
5,322,075 A 6/1994 Deevi et al.
5,322,076 A 6/1994 Brinkley et al.
5,339,838 A 8/1994 Young et al.
5,353,813 A 10/1994 Deevi et al.
5,360,023 A 11/1994 Blakley et al.
5,372,148 A 12/1994 McCafferty et al.
5,377,698 A 1/1995 Litzinger et al.
5,387,416 A 2/1995 White et al.
5,468,936 A 11/1995 Deevi et al.
5,498,850 A 3/1996 Das
5,498,855 A 3/1996 Deevi et al.
5,501,237 A 3/1996 Young et al.
5,530,225 A 6/1996 Hajaligol
5,551,451 A 9/1996 Riggs et al.
5,573,692 A 11/1996 Das et al.
5,591,368 A 1/1997 Fleischhauer et al.
5,665,262 A 9/1997 Hajaligol
5,666,977 A 9/1997 Higgins et al.
5,697,385 A 12/1997 Seymour et al.
5,934,289 A 8/1999 Watkins et al.
5,954,979 A 9/1999 Counts et al.
5,967,148 A 10/1999 Harris et al.
6,040,560 A 3/2000 Fleischhauer et al.
6,053,176 A 4/2000 Adams et al.
6,164,287 A 12/2000 White
6,196,218 B1 3/2001 Voges
6,216,707 B1 4/2001 Kumar et al.
6,701,936 B2 3/2004 Shafer et al.
6,772,756 B2 8/2004 Shayan
6,803,545 B2 10/2004 Blake et al.
6,810,883 B2 11/2004 Felter et al.
6,854,461 B2 2/2005 Nichols
6,974,590 B2 12/2005 Pather et al.
7,011,096 B2 3/2006 Li et al.
7,017,585 B2 3/2006 Li et al.
7,025,066 B2 4/2006 Lawson et al.
7,040,314 B2 5/2006 Nguyen et al.
7,290,549 B2 11/2007 Banerjee et al.
7,293,565 B2 11/2007 Griffen et al.
7,381,667 B2 6/2008 Bergquist et al.
7,398,783 B2 7/2008 Biggs et al.
7,513,253 B2 4/2009 Kobayashi
7,615,184 B2 11/2009 Lobovsky
7,647,932 B2 1/2010 Cantrell et al.
7,726,320 B2 6/2010 Robinson et al.
7,832,410 B2 11/2010 Hon
7,836,897 B2 11/2010 Borschke et al.
7,896,006 B2 3/2011 Hamano
8,205,622 B2 6/2012 Pan
8,402,976 B2 3/2013 Fernando et al.
8,424,541 B2 4/2013 Crawford et al.
8,430,106 B2 4/2013 Potter et al.
8,499,766 B1 8/2013 Newton
8,539,959 B1 9/2013 Scatterday
8,627,828 B2 1/2014 Strickland et al.
8,794,231 B2 8/2014 Thorens et al.
8,839,799 B2 9/2014 Conner et al.
8,851,083 B2 10/2014 Oglesby et al.
8,869,804 B2 10/2014 Mishra et al.
8,881,737 B2 11/2014 Collett et al.
8,910,639 B2 12/2014 Chang et al.
8,915,254 B2 12/2014 Monsees et al.
9,078,473 B2 7/2015 Worm et al.
9,107,453 B2 8/2015 Dube et al.
9,149,072 B2 10/2015 Conner et al.
9,215,895 B2 12/2015 Bowen et al.
9,220,302 B2 12/2015 DePiano et al.
9,254,002 B2 2/2016 Chong et al.
9,307,787 B2 4/2016 Sun et al.
9,423,152 B2 8/2016 Ampolini et al.
9,484,155 B2 11/2016 Peckerar et al.
9,609,893 B2 4/2017 Novak et al.
9,675,102 B2 6/2017 Hunt et al.
9,839,237 B2 12/2017 Chang et al.
9,839,238 B2 12/2017 Worm et al.
9,861,773 B2 1/2018 Terry et al.
9,974,334 B2 5/2018 Dooley et al.
10,015,989 B2 7/2018 Davis et al.
10,034,494 B2 7/2018 Ampolini et al.
10,058,123 B2 8/2018 Taluskie et al.
10,058,125 B2 8/2018 Worm et al.
10,080,388 B2 9/2018 Sebastian et al.
10,117,460 B2 11/2018 Sears et al.
10,172,388 B2 1/2019 Sears et al.
10,196,778 B2 2/2019 Sebastian et al.
10,226,073 B2 3/2019 Bless et al.
10,285,451 B2 5/2019 Bless et al.
10,321,711 B2 6/2019 Henry, Jr. et al.
10,366,641 B2 7/2019 Sebastian et al.
10,500,600 B2 12/2019 Henry, Jr. et al.
10,813,385 B2 10/2020 Sur
10,888,119 B2 1/2021 Ampolini et al.
2004/0255968 A1 12/2004 Perfetti et al.
2005/0066986 A1 3/2005 Nestor et al.
2006/0196518 A1 9/2006 Hon
2007/0215167 A1 9/2007 Crooks et al.
2008/0236602 A1 10/2008 Bereman
2009/0044818 A1 2/2009 Takeuchi et al.
2010/0018539 A1 1/2010 Brinkley et al.
2010/0024834 A1 2/2010 Ogelsby et al.
2010/0307518 A1 12/2010 Wang
2013/0008457 A1 1/2013 Zheng et al.
2013/0247910 A1* 9/2013 Postma ..... A61M 16/10 128/203.26
2013/0255702 A1 10/2013 Griffith et al.
2015/0020823 A1 1/2015 Lipowicz et al.
2015/0020825 A1 1/2015 Galloway et al.
2015/0020830 A1 1/2015 Koller et al.

(56) References Cited

U.S. PATENT DOCUMENTS

| | | | | |
|---|---|---|---|---|
| 2015/0216232 | A1 | 8/2015 | Bless et al. | |
| 2015/0313283 | A1 | 11/2015 | Collett et al. | |
| 2015/0335070 | A1 | 11/2015 | Sears et al. | |
| 2016/0261020 | A1 | 9/2016 | Marion et al. | |
| 2017/0027220 | A1 | 2/2017 | Sebastian et al. | |
| 2017/0112196 | A1 | 4/2017 | Sur et al. | |
| 2017/0291757 | A1 | 10/2017 | Sebastian et al. | |
| 2018/0020722 | A1 | 1/2018 | Davis et al. | |
| 2018/0020723 | A1 | 1/2018 | Davis et al. | |
| 2018/0274354 | A1 | 9/2018 | Nesgaard | |
| 2018/0279673 | A1 | 10/2018 | Sebastian et al. | |
| 2019/0082735 | A1 | 3/2019 | Phillips et al. | |
| 2019/0124979 | A1 | 5/2019 | Sebastian et al. | |
| 2020/0015519 | A1 | 1/2020 | Conner et al. | |
| 2020/0107579 | A1* | 4/2020 | Courbat | A24F 40/465 |
| 2020/0163389 | A1 | 5/2020 | Sur | |
| 2020/0367572 | A1 | 11/2020 | Hejazi et al. | |
| 2021/0015172 | A1 | 1/2021 | Conner et al. | |
| 2021/0015173 | A1 | 1/2021 | Cox et al. | |
| 2021/0015174 | A1 | 1/2021 | Cox et al. | |
| 2021/0015175 | A1 | 1/2021 | Jackson et al. | |
| 2021/0015176 | A1 | 1/2021 | Conner et al. | |
| 2021/0015177 | A1 | 1/2021 | Cox et al. | |
| 2021/0127748 | A1 | 5/2021 | Lim et al. | |
| 2021/0169148 | A1 | 6/2021 | Nakano et al. | |
| 2021/0282454 | A1 | 9/2021 | Woodcock et al. | |
| 2022/0071304 | A1* | 3/2022 | Tatsuta | A24F 40/60 |
| 2022/0071305 | A1* | 3/2022 | Tatsuta | A24F 40/60 |
| 2023/0051032 | A1* | 2/2023 | Han | A24F 13/06 |

FOREIGN PATENT DOCUMENTS

| | | | | |
|---|---|---|---|---|
| KR | 2020-0004695 | A | 1/2020 | |
| RU | 2614600 | C2 * | 3/2017 | A24F 40/30 |
| WO | WO 1997/06786 | | 2/1997 | |
| WO | WO 1998/57556 | | 12/1998 | |
| WO | WO 2005/041699 | | 5/2005 | |
| WO | 2007012007 | A2 | 1/2007 | |
| WO | WO 2010/003480 | | 1/2010 | |
| WO | WO 2013/089551 | | 6/2013 | |
| WO | WO 2014/182736 | | 11/2014 | |
| WO | 2018091627 | A1 | 5/2018 | |
| WO | WO 2019/096983 | | 5/2019 | |
| WO | WO 2019/186147 | | 10/2019 | |

OTHER PUBLICATIONS

Notice of Preliminary Rejection mailed Apr. 1, 2026, in corresponding Korean Patent Application No. 2023-7023059.

* cited by examiner

SLEEVE FOR SMOKING ARTICLE

BACKGROUND

Field of the Disclosure

The present disclosure relates to smoking articles and accessories for smoking articles, sometimes referred to as tobacco heating products, capable of heating tobacco materials without combusting the tobacco materials contained within the tobacco heating products.

Description of Related Art

Many smoking articles have been proposed through the years as improvements upon, or alternatives to, smoking products based upon combusting tobacco for use. Some example alternatives have included devices wherein a solid or liquid fuel is combusted to transfer heat to tobacco or wherein a chemical reaction is used to provide such heat source. Examples include the smoking articles described in U.S. Pat. No. 9,078,473 to Worm et al., which is incorporated herein by reference. Such devices, commonly referred to as smoking articles or tobacco heating products, allow for tobacco materials to be heated without significant combustion or burning of the tobacco material.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al.; and U.S. Pat. App. Pub. Nos. 2013/0255702 to Griffith, Jr. et al.; and 2014/0096781 to Sears et al., which are incorporated herein by reference. See also, for example, the various types of smoking articles, aerosol delivery devices and electrically powered heat generating sources referenced by brand name and commercial source in U.S. Pat. App. Pub. No. 2015/0216232 to Bless et al., which is incorporated herein by reference. Additional types of smoking articles, aerosol delivery devices and electrically powered heat generating sources referenced by brand name and commercial source are listed in U.S. Pat. App. Pub. No. 2015/0245659 to DePiano et al., which is also incorporated herein by reference in its entirety. Other representative cigarettes or smoking articles that have been described and, in some instances, been made commercially available include those described in U.S. Pat. No. 4,735,217 to Gerth et al.; U.S. Pat. Nos. 4,922,901, 4,947,874, and 4,947,875 to Brooks et al.; U.S. Pat. No. 5,060,671 to Counts et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; U.S. Pat. App. Pub. No. 2009/0095311 to Hon; U.S. Pat. App. Pub. Nos. 2006/0196518, 2009/0126745, and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; and WO 2010/091593 to Hon, which are incorporated herein by reference.

In yet another regard, certain types of cigarettes, such as those marketed commercially under the brand names "Premier" and "Eclipse" by R. J. Reynolds Tobacco Company, have incorporated combustible fuel sources (e.g., carbonaceous fuel elements) that generate heat for the production of a smoke-like aerosol. See, for example, the types of smoking articles set forth in U.S. Pat. No. 4,793,365 to Sensabaugh et al.; U.S. Pat. No. 5,183,062 to Clearman et al.; and U.S. Pat. No. 5,551,451 to Riggs et al.; and U.S. Patent Application Publication Nos. 2007/0023056 to Cantrell et al.; 2007/0215167 to Crooks et al; and 2007/0215168 to Banerjee et al.; each of which is incorporated herein by reference.

Articles that produce the taste and sensation of smoking by heating tobacco, tobacco-derived materials, or other plant derived materials, without a significant degree of burning or combustion, have suffered from inconsistent and detrimental performance characteristics. In some instances, some smoking articles, particularly those that employ a traditional paper wrapping material, are also prone to scorching of the paper wrapping material overlying an ignitable fuel source, due to the high temperature attained by the fuel source in proximity to the paper wrapping material. Generally, overheating of smoking articles can also cause unwanted scorching or burning of internal tobacco materials. This can reduce enjoyment of the smoking experience for some consumers and can mask or undesirably alter the flavors delivered to the consumer by the aerosol delivery components of the smoking articles. In further instances, traditional types of smoking articles can produce relatively significant levels of gasses, such as carbon monoxide and/or carbon dioxide, during use (e.g., as products of carbon combustion). In still further instances, traditional types of smoking articles may suffer from poor performance with respect to aerosolizing the aerosol forming component(s).

Accordingly, it can be desirable to provide smoking articles and accessories for smoking articles that can provide the sensations of cigarette, cigar, or pipe smoking, that does so without overheating the tobacco material and that does so with advantageous performance characteristics.

BRIEF SUMMARY

The present disclosure relates to sleeves for smoking articles and, in particular, temperature regulating sleeves that may be configured to provide thermal regulation of a smoking article received therein. In one aspect of the present disclosure, for example, a temperature regulating sleeve for a smoking article may comprise an outer shell, an inner chamber at least partially defined within the outer shell and configured to receive at least a portion of a smoking article, an opening through the outer shell configured for egress of an aerosol therethrough, a power source positioned within the outer shell, at least one control component positioned within the outer shell, one or more sensors positioned in communication with the inner chamber, and one or more ventilation components positioned in communication with the inner chamber, wherein the at least one control component is configured to receive one or more inputs produced by the one or more sensors, the one or more inputs being related to one or both of a temperature within the inner chamber and an airflow in the inner chamber, and wherein the at least one control component is configured to provide an output to the one or more ventilation components to effect automatic adjustment of at least a temperature of at least a portion of the smoking article.

In some embodiments, the outer shell may comprise a thermally-insulating material. In some embodiments, the thermally-insulating material may be a ceramic or a plastic material. In some embodiments, the at least one control component, the one or more sensors, and the one or more ventilation components are in electrical communication. In some embodiments, the one or more ventilation components each comprises an air passage extending through the outer shell and a damper, wherein the damper is configurable between an open position allowing air flow into the inner chamber and a closed position restricting air flow into the inner chamber. In some embodiments, the position of the damper is configured to be selectively controlled by the at least one control component. In some embodiments, the damper may include a heat-responsive material. In some embodiments, the heat responsive material can be configured to spontaneously change between a closed position and an open position at approximately a chosen threshold temperature.

In some embodiments, the one or more sensors may include one or more temperature sensors and one or more flow sensors. In some embodiments, the one or more temperature sensors include one or more heat probes configured to be in heat-detecting relationship with the at least a portion of the smoking article when received by the inner chamber. In some embodiments, a temperature regulating sleeve may further comprise one or more heaters in electrical communication with the at least one control component. In some embodiments, the one or more heaters may be configured to be selectively activated by the at least one control component. In some embodiments, the one or more heaters are configured to be in a heating relationship with one or more areas of the at least a portion of the smoking article when received by the inner chamber. In some embodiments, the one or more heaters include one or more thermistors.

In some embodiments, the temperature regulating sleeve may further comprise one or more porous structures positioned within the outer shell and arranged relative to the opening in the outer shell such that the aerosol exiting through the opening passes one or both of through and around the one or more porous structures. In some embodiments, the one or more porous structures may be configured to contain a non-tobacco flavored liquid, a tobacco extract or distillate, a flavoring agent, an aerosol precursor composition, and combinations thereof. In some embodiments, the power source may comprise one or both of a battery and a capacitor.

In some embodiments, the temperature regulating sleeve may further comprise an input element positioned on an outer surface of the outer shell. In some embodiments, the input element is configured to one or both of control the supply of electric power from the power source to one or more components of the temperature regulating sleeve and control activation and deactivation of the temperature regulating sleeve. In some embodiments, the temperature regulating sleeve may further comprise a feedback element positioned on an outer surface of the outer shell. In some embodiments, the feedback element may be configured to provide one or more of feedback related to the number of puffs taken and/or remaining until expiration, total puff time and/or total puff time remaining, a heat map showing a temperature gradient at various positions along the smoking article, and alerts for overheating and underheating at various positions along the smoking article.

The present disclosure includes, without limitation, the following embodiments.

Embodiment 1: A temperature regulating sleeve for a smoking article, the temperature regulating sleeve comprising: an outer shell; an inner chamber at least partially defined within the outer shell and configured to receive at least a portion of a smoking article; an opening through the outer shell configured for egress of an aerosol therethrough; a power source positioned within the outer shell; at least one control component positioned within the outer shell; one or more sensors positioned in communication with the inner chamber; and one or more ventilation components positioned in communication with the inner chamber; wherein the at least one control component is configured to receive one or more inputs produced by the one or more sensors, the one or more inputs being related to one or both of a temperature within the inner chamber and an airflow in the inner chamber; and wherein the at least one control component is configured to provide an output to the one or more ventilation components to effect automatic adjustment of at least a temperature of at least a portion of the smoking article.

Embodiment 2: The temperature regulating sleeve according to embodiment 1, wherein the outer shell comprises a thermally-insulating material.

Embodiment 3: The temperature regulating sleeve according to any of embodiments 1-2, wherein the thermally-insulating material is a ceramic or a plastic material.

Embodiment 4: The temperature regulating sleeve according to any of embodiments 1-3, wherein the at least one control component, the one or more sensors, and the one or more ventilation components are in electrical communication.

Embodiment 5: The temperature regulating sleeve according to any of embodiments 1-4, wherein the one or more ventilation components each comprises an air passage extending through the outer shell and a damper, wherein the damper is configurable between an open position allowing air flow into the inner chamber and a closed position restricting air flow into the inner chamber.

Embodiment 6: The temperature regulating sleeve according to any of embodiments 1-5, wherein the position of the damper is configured to be selectively controlled by the at least one control component.

Embodiment 7: The temperature regulating sleeve according to any of embodiments 1-5, wherein the damper includes a heat-responsive material.

Embodiment 8: The temperature regulating sleeve according to any of embodiments 1-5 and 7, wherein the heat responsive material is configured to spontaneously change between a closed position and an open position at approximately a chosen threshold temperature.

Embodiment 9: The temperature regulating sleeve according to any of embodiments 1-8, wherein the one or more sensors includes one or more temperature sensors and one or more flow sensors.

Embodiment 10: The temperature regulating sleeve according to any of embodiments 1-9, wherein the one or more temperature sensors include one or more heat probes configured to be in heat-detecting relationship with the at least a portion of the smoking article when received by the inner chamber.

Embodiment 11: The temperature regulating sleeve according to any of embodiments 1-10, further comprising one or more heaters in electrical communication with the at least one control component.

Embodiment 12: The temperature regulating sleeve according to any of embodiments 1-11, wherein the one or more heaters are configured to be selectively activated by the at least one control component.

Embodiment 13: The temperature regulating sleeve according to any of embodiments 1-12, wherein the one or more heaters are configured to be in a heating relationship with one or more areas of the at least a portion of the smoking article when received by the inner chamber.

Embodiment 14: The temperature regulating sleeve according to any of embodiments 1-13, wherein the one or more heaters include one or more thermistors.

Embodiment 15: The temperature regulating sleeve according to any of embodiments 1-14, further comprising one or more porous structures positioned within the outer shell and arranged relative to the opening in the outer shell such that the aerosol exiting through the opening passes one or both of through and around the one or more porous structures.

Embodiment 16: The temperature regulating sleeve according to any of embodiments 1-15, wherein the one or more porous structures is configured to contain a non-tobacco flavored liquid, a tobacco extract or distillate, a flavoring agent, an aerosol precursor composition, and combinations thereof.

Embodiment 17: The temperature regulating sleeve according to any of embodiments 1-16, wherein the power source comprises one or both of a battery and a capacitor.

Embodiments 18: The temperature regulating sleeve according to any of embodiments 1-17, further comprising an input element positioned on an outer surface of the outer shell.

Embodiment 19: The temperature regulating sleeve according to any of embodiments 1-18, wherein the input element is configured to one or both of control the supply of electric power from the power source to one or more components of the temperature regulating sleeve and control activation and deactivation of the temperature regulating sleeve.

Embodiment 20: The temperature regulating sleeve according to any of embodiments 1-19, further comprising a feedback element positioned on an outer surface of the outer shell.

Embodiment 21: The temperature regulating sleeve according to any of embodiments 1-20, wherein the feedback element is configured to provide feedback related to the number of puffs taken or remaining until expiration, total puff time or total puff time remaining until expiration, a heat map showing a temperature gradient at various positions along the smoking article, and alerts for overheating and underheating at various positions along the smoking article.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a particular embodiment description herein. This disclosure is intended to be read holistically such that any separable features or elements of the disclosed invention, in any of its various aspects or embodiments, should be viewed as combinable unless the context clearly dictates otherwise.

BRIEF DESCRIPTION OF THE FIGURES

Figure 1:
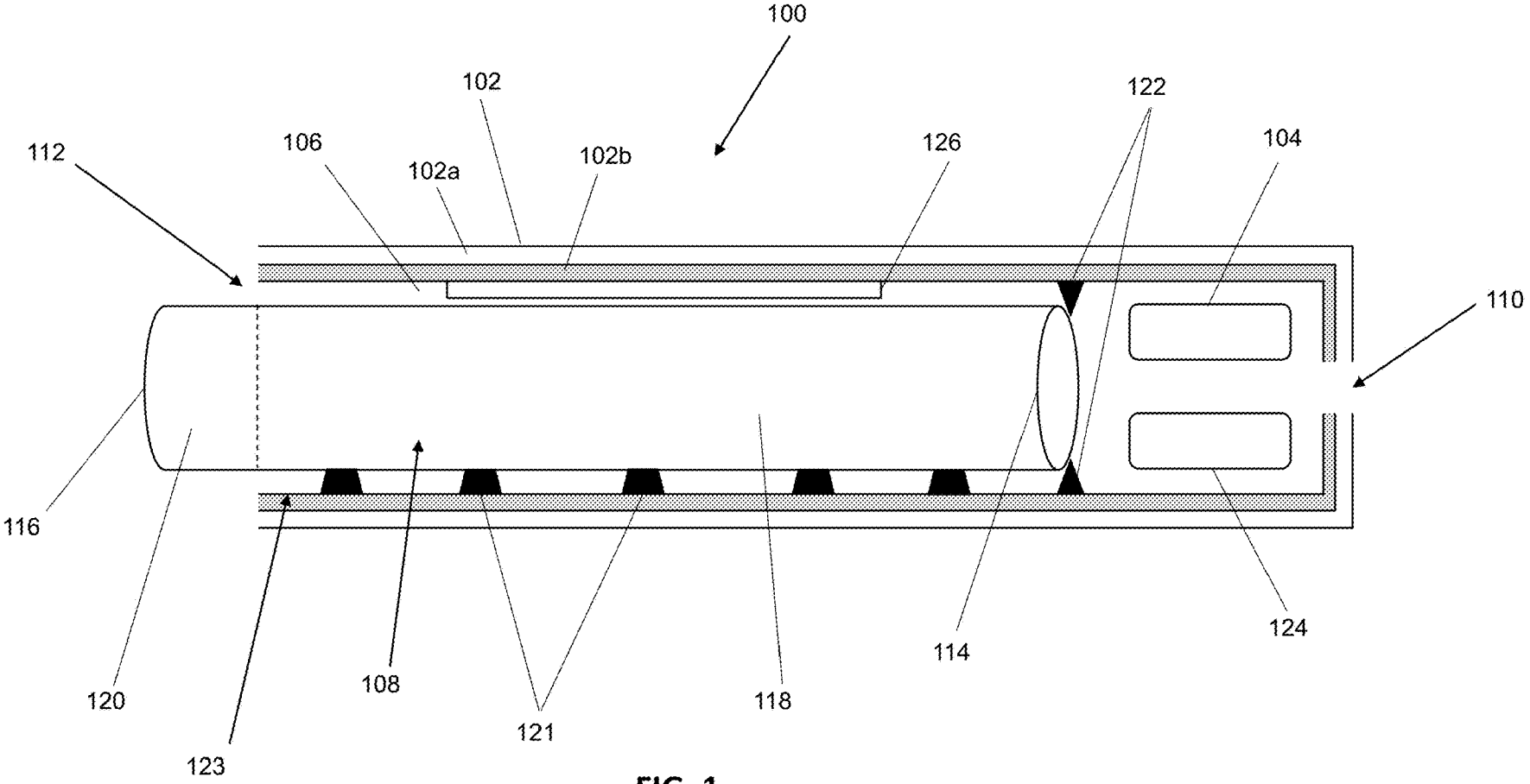
Figure 2:
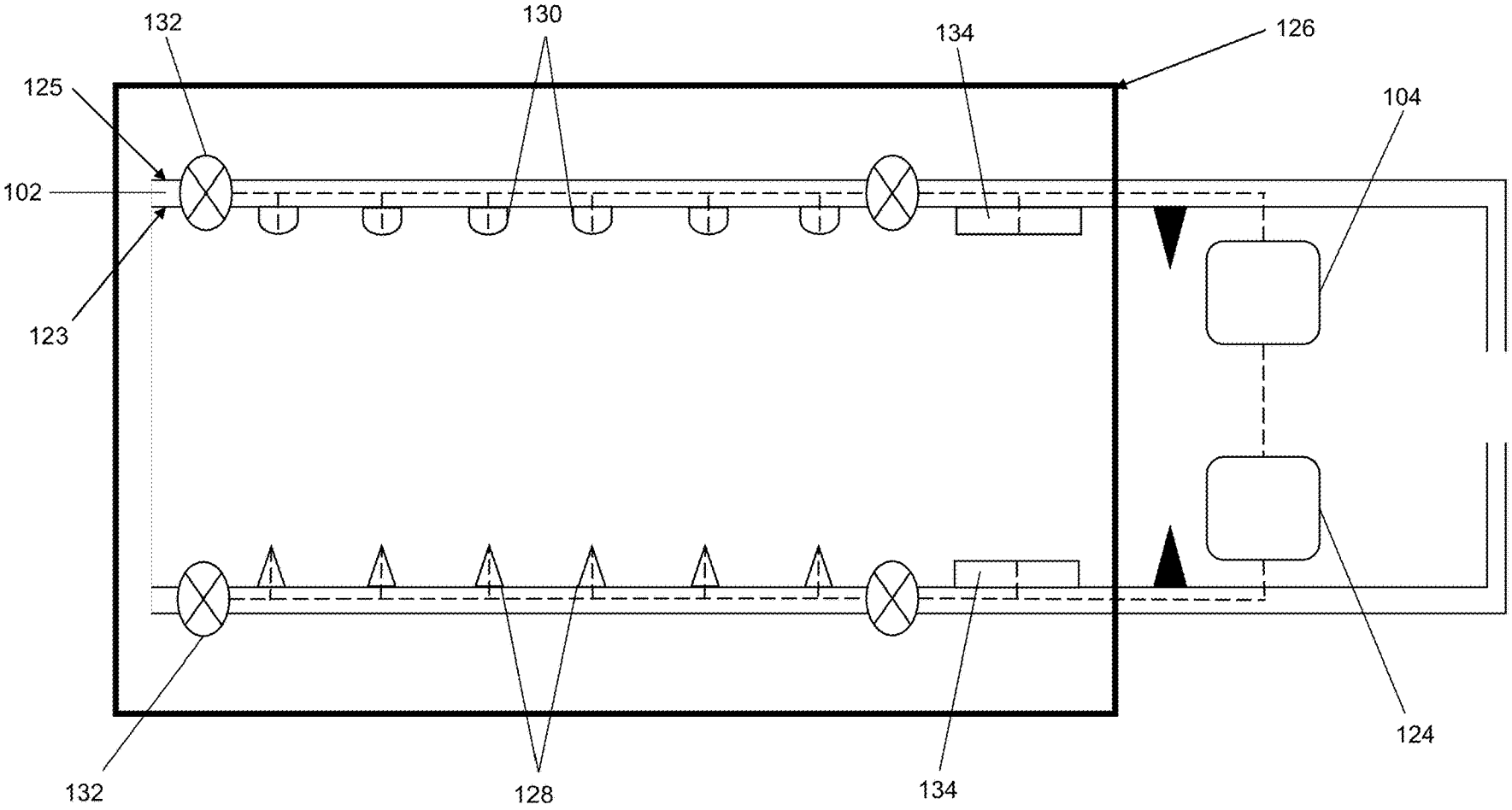
Figure 3:
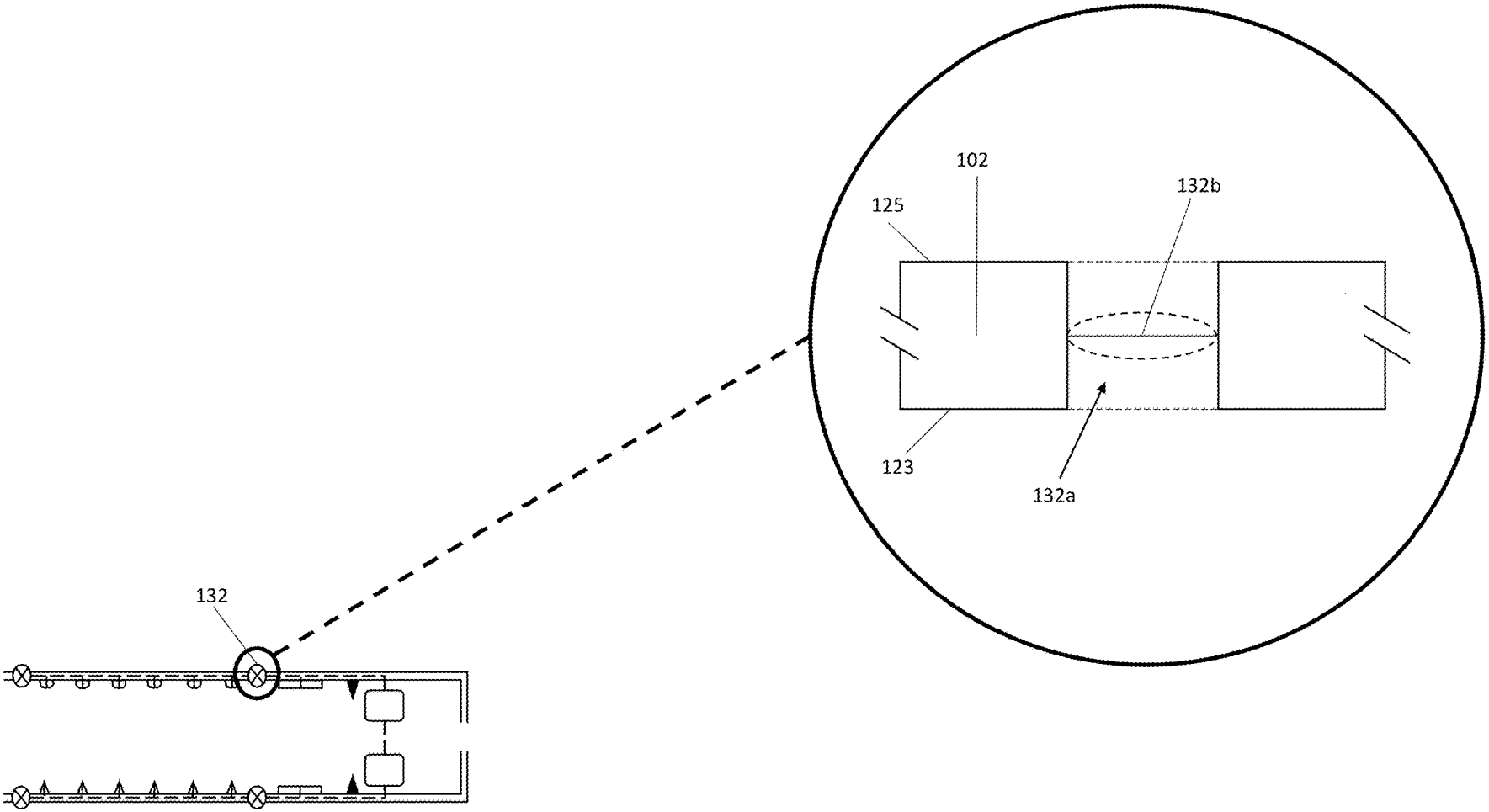
Figure 4:
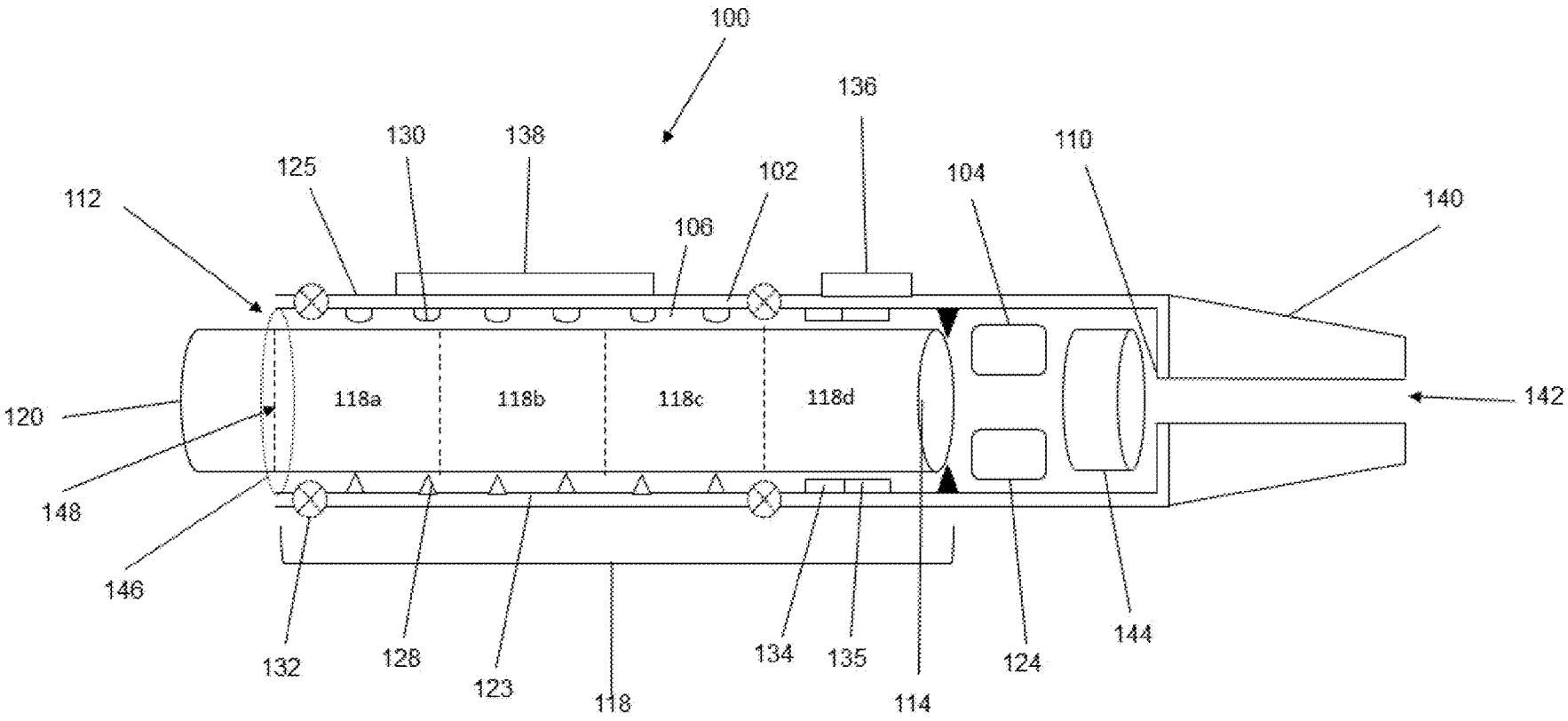

Having thus described aspects of the disclosure in the foregoing general terms, reference will now be made to the accompanying drawings, which are not necessarily drawn to scale, and wherein:

FIG. 1 illustrates a side cross-sectional view of a temperature regulating sleeve for use with a smoking article, according to an example embodiment of the present disclosure;

FIG. 2 illustrates a highlighted view of the thermal regulating component including one or more temperature sensors, one or more flow sensors, one or more heaters, and one or more ventilation components in electrical communication with the at least one control component and the power source, according to an example embodiment of the present disclosure;

FIG. 3 illustrates a cut-away perspective view of an example ventilation component including both an air passage through the outer shell and a damper, according to an example embodiment of the present disclosure; and FIG. 4 illustrates a side cross-sectional view of a temperature regulating sleeve for use with a smoking article, according to an example embodiment of the present disclosure.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the" and the like include plural referents unless the context clearly dictates otherwise. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As described hereinafter, example embodiments of the present disclosure relate to temperature regulating sleeves for use with smoking articles. As used herein, the term "smoking article" is intended to mean an article and/or device that provides many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article and/or device. As used herein, the term "smoking article" does not necessarily mean that, in operation, the article or device produces smoke in the sense of an aerosol resulting from by-products of combustion or pyrolysis of tobacco, but rather, that the article or device yields vapors (including vapors within aerosols that are considered to be visible aerosols that might be considered to be described as smoke-like) resulting from volatilization or vaporization of certain components, elements, and/or the like of the article and/or device. In some embodiments, smoking articles as used herein may be in the form of a tobacco heating product (THP), e.g., such as commonly referred to as heat-not-burn (HNB) devices, carbon tobacco heated products (cTHP), and electric tobacco heated products (eTHP). Non-limiting examples of such devices to which any part or all of the present disclosure may be incorporated are described in U.S. Pat. No. 4,793,365 to Sensabaugh et al.; U.S. Pat. No. 5,183,062 to Clearman et al.; U.S. Pat. No. 5,551,451 to Riggs et al.; and U.S. Patent Application Publication Nos. 2007/0023056 to Cantrell et al.; 2007/0215167 to Crooks et al; and 2007/0215168 to Banerjee et al., which are all incorporated herein by reference entirely. While the temperature regulating sleeves of the present disclosure are generally described herein below in terms of embodiments incorporating carbon-tip THP products in particular, it should be understood that the mechanisms, components, features, and methods may be embodied in many different forms and associated with a variety of smoking articles as noted herein above. Accordingly, it should be understood that the description of the mechanisms, components, features, and methods of providing temperature regulating sleeves for smoking articles as disclosed herein are discussed in terms of embodiments relating to carbon-tip tobacco heating products by way of example only, and may be embodied and used with various other smoking articles.

According to certain aspects of the present disclosure, it may be advantageous to provide a smoking article that is easy to use and that provides reusable components. In some embodiments, such smoking articles may include one or more removable cartridges (e.g., including at least a combustible carbonaceous material and a substrate material, e.g., such as tobacco) and a holder. Some examples of holders and removable cartridge configurations that may be used in conjunction with the temperature regulating sleeves of the present disclosure (e.g., used as a smoking article as described herein) are described in U.S. patent application Ser. No. 16/035,103, filed on Jul. 13, 2018, and titled Smoking Article with Detachable Cartridge; U.S. patent application Ser. No. 16/515,637, filed on Jul. 18, 2019, and titled Aerosol Delivery Device with Consumable Cartridge; U.S. patent application Ser. No. 16/516,573, filed on Jul. 19, 2019, and titled Holder for Aerosol Delivery Device with Detachable Cartridge; U.S. patent application Ser. No. 16/516,601, filed on Jul. 19, 2019, titled Aerosol Delivery Device with Sliding Sleeve; U.S. patent application Ser. No. 16/516,621, filed on Jul. 19, 2019, and titled Aerosol Delivery Device with Clamshell Holder for Cartridge; U.S. patent application Ser. No. 16/516,821, filed on July 19, and titled Aerosol Delivery Device with Rotatable Enclosure for Cartridge; and U.S. patent application Ser. No. 16/516,932, filed on Jul. 19, 2019, and titled Aerosol Delivery Device with Separable Heat Source and Substrate; each of which is incorporated herein by reference in its entirety. In some embodiments, one or both of the holder or the removable cartridge (and/or any of their subcomponents) may have a variety of shapes, e.g., including, but not limited to, a substantially rectangular shape, such as a substantially rectangular cuboid shape, a substantially cylindrical shape, a small box shape, various pod mod shapes, a fob-shape, and/or various other hand-held shapes.

In some embodiments, these smoking articles may be characterized as being vapor-producing articles or medicament delivery articles. Thus, such articles or devices may be adapted so as to provide one or more substances (e.g., flavors, nicotine, and/or active ingredients) in an inhalable form or state. For example, inhalable substances may be substantially in the form of a vapor (i.e., a substance that is in the gas phase at a temperature lower than its critical point). Alternatively, inhalable substances may be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like.

As noted above, temperature regulating sleeves of the present disclosure may be configured for use with tobacco heating products in some embodiments, for example, products using an ignitable heat source to heat a material to form an inhalable substance (e.g., such as carbon-tip heated tobacco products). In such smoking articles, the material is generally heated without combusting the material to any significant degree. That is, use of components of various smoking articles does not result in the production of smoke in the sense that aerosol results principally from by-products of combustion or pyrolysis of tobacco, but rather, use of those preferred systems results in the production of vapors resulting from heating, without burning or combusting, of the tobacco incorporated therein. In some example embodiments, suitable smoking articles for use with various embodiments described further herein below may be characterized as heat-not-burn cigarettes, and those heat-not-burn cigarettes most preferably incorporate tobacco and/or components derived from tobacco, and hence deliver tobacco-derived components in aerosol form. Smoking articles themselves may provide many of the sensations (e.g., inhalation and exhalation rituals, types of tastes or flavors, organoleptic effects, physical feel, use rituals, visual cues such as those provided by visible aerosol, and the like) of smoking a cigarette, cigar or pipe that is employed by lighting and burning tobacco (and hence inhaling tobacco smoke), without any substantial degree of combustion of any component thereof. For example, the user of smoking articles in accordance with some example embodiments of the present disclosure (e.g., when used in combination with temperature regulating sleeves according to the present disclosure) can hold and use that device much like a smoker employs a traditional type of smoking article, draw on one end of that piece for inhalation of aerosol produced by that piece, take or draw puffs at selected intervals of time, and the like.

Advantageously, the temperature regulating sleeves according to the present disclosure can be adapted to or configured to substantially prevent smoking articles from overheating (e.g., which causes unwanted scorching/burning of internal tobacco materials and charring of the tipping paper of cigarette rods), and/or substantially prevent uneven heating at various positions along the length of the smoking article (e.g., which can result in portions of the smoking article being overheated and portions of the smoking article being underheated). By substantially preventing overheating of smoking articles, the presently disclosed sleeves can be useful to reduce or prevent formation of negative sensory attributes and/or release of one or more compounds from the tobacco materials contained therein, particularly compounds that may arise from incomplete combustion (or pyrolysis) and/or degradation of tobacco cigarettes through heat (i.e., thermogenic degradation). In some embodiments, temperature regulating sleeves according to the present disclosure may be configured to provide temperature regulation of various smoking articles and, in particular, to prevent overheating or charring of such smoking articles and the components provided therein.

In one aspect of the present disclosure, a temperature regulating sleeve 100 may comprise an outer shell 102, e.g., such as the embodiments depicted in FIG. 1. In some embodiments, some or all of the outer shell 102 may comprise a lightweight and/or thermally stable material, e.g., such as a thermally-insulating material. In some embodiments, for example, the outer shell may provide an insulating quality which retains heat within the temperature regulating sleeve without becoming hot to the touch on the exterior surface. In some embodiments, the outer shell may be characterized as being thin-walled. In some embodiments, the outer shell may include more than one component, for example, the outer 102 shell may comprise an outer casing 102*a* and an inner lining 102*b*, e.g., as depicted in FIG. 1. In such embodiments, one or both of the outer casing and the inner lining may comprise a thermally-insulating material. For example, in some embodiments the inner lining may comprise a thermally insulating material, whereas the outer casing may comprise a non-insulating material that is more cost effective. In some embodiments, the inner lining may only be present in the section of the inner chamber receiving the smoking article, for example. The types of thermally-insulating materials used in the outer shell, or in the outer casing and/or the inner lining thereof, may vary. Generally, suitable materials may include, for example, ceramics, polymeric materials, plastic-based materials, carbonaceous materials, and the like. In some embodiments, the outer shell or casing may comprise a non-conductive insulating material and/or construction including, but not limited to, an insulating polymer (e.g., plastic or cellulose), glass, rubber, ceramic, porcelain, a double-walled vacuum structure, or any combinations thereof. In certain other embodiments, the outer shell or casing may comprise a carbonaceous material, e.g., such as wood or wood-based composites.

In some embodiments, the temperature regulating sleeve may include a power source 104 positioned within the outer shell 102. For example, the power source may be in the form of a battery or other electrical power source capable of providing current flow sufficient to provide various functionalities to the temperature regulating sleeve; e.g., such as powering of a heating source, powering of one or more sensors, powering of control systems, powering of indicators, and the like. These and other functionalities will be discussed further herein. In some embodiments, the power source may be adapted to or configured to deliver sufficient power to rapidly activate these one or more components within the temperature regulating sleeve and power the temperature regulating sleeve through use for a desired duration of time. In some embodiments, the power source is sized to fit conveniently within the temperature regulating sleeve so that the temperature regulating sleeve can be easily handled, e.g., such that the temperature regulating sleeve is not significantly larger than the smoking article itself. Examples of useful power sources include lithium-ion batteries that may be rechargeable, e.g., a rechargeable lithium-manganese dioxide battery. In particular, lithium polymer batteries can be used as such batteries can provide increased safety. Other types of batteries, e.g., N50-AAA CADNICA nickel-cadmium cells, may also be used. Additionally, a power source may be sufficiently lightweight to not detract from a desirable smoking experience. Some examples of suitable power sources are described in U.S. Pat. No. 9,484,155 to Peckerar et al. and U.S. Patent Application Publication No. 2017/0112191 to Sur et al., filed Oct. 21, 2015, the disclosures of which are incorporated herein by reference in their respective entireties.

In some embodiments, the power source may be a reusable and/or a rechargeable power source, e.g., which may include a solid-state battery, a thin-film solid-state battery, a rechargeable super capacitor, or the like and may be combined with any type of recharging technology, including connection to a wall charger, connection to a car charger, connection to a computer, a solar array of solar cells, a wireless charger, or other suitable charging connection. For example, in some embodiments, the temperature regulating sleeve may include any of a number of different terminals, electrical connectors or the like to connect to a suitable charger, and in some examples, to connect to other peripherals for communication. More specific suitable examples include direct current (DC) connectors such as cylindrical connectors, cigarette lighter connectors and USB connectors including those specified by USB 1.x (e.g., Type A, Type B), USB 2.0 and its updates and additions (e.g., Mini A, Mini B, Mini AB, Micro A, Micro B, Micro AB) and USB 3.x (e.g., Type A, Type B, Micro B, Micro AB, Type C), proprietary connectors such as Apple's Lightning connector, and the like. The temperature regulating sleeve may directly connect with the charger or other peripheral, or the two may connect via an appropriate cable that also has suitable connectors. In examples in which the two are connected by cable, the sleeve and charger or other peripheral may have the same or different type of connector with the cable having the one type of connector or both types of connectors.

In examples involving induction-powered charging, the temperature regulating sleeve may be equipped with wireless charging technology. For example, the temperature regulating sleeve may be configured to support inductive wireless charging technology and include an induction receiver to connect with a wireless charger, charging pad or the like that includes an induction transmitter and uses inductive wireless charging (including for example, wireless charging according to the Qi wireless charging standard from the Wireless Power Consortium (WPC)). Or the power source may be recharged from a wireless radio frequency (RF) based charger. An example of an inductive wireless charging system is described in U.S. Pat. App. Pub. No. 2017/0112196 to Sur et al., which is incorporated herein by reference in its entirety.

One or more connections may be employed to connect the power source to a recharging technology, and some may involve a charging case, cradle, dock, sleeve or the like. More specifically, for example, the outer shell of the temperature regulating sleeve may be configured to engage a cradle that includes a USB connector to connect to a power supply. Or in another example, the outer shell may be configured to fit within and engage a sleeve that includes a USB connector to connect to a power supply. In these and similar examples, the USB connector may connect directly to the power source, or the USB connector may connect to the power source via a suitable power adapter.

In some embodiments, the power source may comprise both a battery and a capacitor. The capacitors may be capable of discharging more quickly than the battery and can be charged between puffs, allowing the battery to discharge into the capacitor at a lower rate than if it were used to power the temperature regulating sleeve directly. For example, a super capacitor, e.g., an electric double-layer capacitor (EDLC), may be used separate from or in combination with a battery. When used alone, the super capacitor may be recharged before use of the temperature regulating sleeve.

Thus, in some embodiments a temperature regulating sleeve may also include a charger component that can be attached to the temperature regulating sleeve between uses to replenish the capacitor.

In some embodiments, the outer shell 102 of the temperature regulating sleeve may define an inner chamber 106 configured to receive at least a portion of a smoking article 108 and a first opening 110 configured for egress of aerosol therethrough (e.g., an aerosol generated by the smoking article during use). In some embodiments, the outer shell may comprise a second opening 112 configured for receiving the smoking article at least partially within the inner chamber 106, wherein the smoking article has a mouth end 114 and a lighting end 116 (e.g., a combustible carbon tip, when the smoking article is a carbon tobacco heated product, or any other type of heat source). As noted above, the inner chamber 106 can receive at least a portion of the smoking article, for example, the inner chamber may be configured to retain at least a first portion 118 of the smoking article therein (e.g., wherein the first portion of the smoking article includes at least a substrate material, e.g., such as a tobacco material). For example, the smoking article 108 can be inserted into the second opening 112 such that the mouth end 114 of the smoking article is functionally aligned with the first opening 110 in the outer shell. Such functional alignment can be an arrangement such that vapor/aerosol drawn through and/or exiting the mouth end 114 of the smoking article 108 can be transmitted to and through the first opening 110. In some embodiments, the mouth end 114 of the smoking article may specifically be positioned proximate to the first opening 110 of the outer shell. Preferably, when the smoking article 108 is fully inserted into the inner chamber 106, a second portion 120 of the smoking article including the lighting end thereof 116 is exposed outside of the second opening 112 in the outer shell. In some embodiments, the inner chamber may comprise one or more ridges (e.g., as depicted at 121 in FIG. 1) positioned along an interior wall 123 of the outer shell and configured to at least temporarily hold the smoking article in place after insertion into the outer shell. In some embodiments, for example, a plurality of ridges may extend longitudinally along the interior wall 123 of the inner chamber so as to provide a secure fit upon receiving the smoking article, e.g., as depicted in FIG. 1. In some embodiments, the inner chamber may additionally, or alternatively, comprise one or more depth guides (e.g., as depicted at 122 in FIG. 1) positioned on the interior wall 123 of the outer shell to prevent the smoking article from being inserted past a defined distance into the inner chamber.

It should be noted that alignment of the components within the temperature regulating sleeve of the present disclosure may vary across different embodiments. In various embodiments, temperature regulating sleeves, components within temperature regulating sleeves, and smoking articles used therewith may have a variety of overall shapes, including, but not limited to, an overall shape that may be defined as being substantially rod-like or substantially tubular-shaped. In some embodiments, for example, the outer shell and the inner chamber may be substantially cylindrical in shape. In other embodiments, the temperature regulating sleeve (and/or any subcomponents) may have other handheld shapes. For example, in some embodiments the temperature regulating sleeve may have a small box shape, a substantially rectangular cuboid shape, various pod mod shapes, or a fob-shape. Temperature regulating sleeves and smoking articles used therewith may have varying cross-sectional shapes (e.g., circle, oval, square, triangle, etc.) all of which are intended to be encompassed by the present disclosure. Thus, any language that is descriptive of the physical shape of the article may also be applied to the individual components thereof in various embodiments as described herein.

In some embodiments, temperature regulating sleeves 100 according to the present disclosure may comprise at least one control component 124 positioned within the outer shell 102 and a thermal regulating component 126 positioned in communication with the inner chamber 106 (e.g., as depicted in FIG. 1). As will be discussed further herein, the thermal regulating component may include various different individual components in different embodiments, including, but not limited to: one or more sensors (e.g., temperature and/or flow sensors), one or more ventilation components, and/or one or more heaters. Generally, the thermal regulating component includes at least one sensor and at least one ventilation component as will be discussed further herein. The at least one control component 124 may be in electrical communication with the power source 104 and one or more additional components within the temperature regulating sleeve, as will be discussed further herein. In some embodiments, the temperature regulating sleeve may comprise multiple control components that individually, or in combination, control the functionality of specific components within the temperature regulating sleeve. As will be discussed further herein, for example, the at least one control component may be configured to receive input data from one or more components within the temperature regulating sleeve (e.g., such as input from one or more sensors regarding temperature and/or flow within the sleeve), process the data received, and send an output (e.g., in the form of electronic feedback) to one or more components of the thermal regulating component (e.g., one or more ventilation components and/or one or more heaters) to ultimately effect an automatic adjustment of a temperature of at least a portion of the smoking article.

A suitable control component may include a number of electronic components, and in some examples may be formed of a printed circuit board (PCB). In some examples, the electronic components include processing circuitry configured to perform data processing, application execution, or other processing, control or management services according to one or more example implementations. The processing circuitry may include a processor embodied in a variety of forms such as at least one processor core, microprocessor, coprocessor, controller, microcontroller or various other computing or processing devices including one or more integrated circuits such as, for example, an ASIC (application specific integrated circuit), an FPGA (field programmable gate array), some combination thereof, or the like. In some examples, the processing circuitry may include memory coupled to or integrated with the processor, and which may store data, computer program instructions executable by the processor, some combination thereof, or the like.

In some example embodiments, the control component may include one or more input/output peripherals, which may be coupled to or integrated with the processing circuitry. More particularly, the control component may include a communication interface to enable wireless communication with one or more networks, computing devices or other appropriately-enabled devices. Examples of suitable communication interfaces are disclosed in U.S. Pat. App. Pub. No. 2016/0261020 to Marion et al., the content of which is incorporated herein by reference. Another example of a suitable communication interface is the CC3200 single chip wireless microcontroller unit (MCU) from Texas Instruments. Additional examples of suitable manners according to which the temperature regulating sleeve may be configured to wirelessly communicate are disclosed in U.S. Pat. App. Pub. No. 2016/0007651 to Ampolini et al., and U.S. Pat. App. Pub. No. 2016/0219933 to Henry, Jr. et al., each of which is incorporated herein by reference. Additional control configurations and components (e.g., such as one or more input or feedback elements) are discussed in more detail herein below and may be incorporated into embodiments of temperature regulating sleeves as discussed herein.

As noted above, in some embodiments, the thermal regulating component 126 may include various different components therein, e.g., such as one or more sensors and one or more ventilation components. In some embodiments, the thermal regulating component, and components thereof, may be positioned in communication with the inner chamber 106 of the outer shell so as to be in thermal communication with at least part of the first portion 118 of the smoking article 108. For example, the thermal regulating component 126 may be positioned to be in thermal communication with a portion of the smoking article 108 that encompasses about 10% to about 90%, about 20% to about 80%, or about 30% to about 70% of the first portion 118 of the smoking article or of the overall length of the smoking article. The thermal regulating component 126 may be a single element or may be comprised of a plurality of individual elements that together form the component, e.g., as depicted in FIG. 2. A "thermal regulating component" as used herein, refers to any component, or combination of components, capable of effecting an automatic adjustment of the temperature of the first portion of the smoking article (e.g., through direct/indirect heating, an increase/reduction in air flow within the sleeve, an increase/reduction in temperature within the sleeve, and the like). For example, the thermal regulating component may include a variety of different individual components or combinations of components, e.g., one or more temperature sensors, and/or one or more flow sensors, and/or one or more heaters, and/or one or more ventilation components, and/or one or more additional components. It should be noted that such components may be used in a variety of different configurations and combinations and the specific configurations and/or combinations of components within the temperature regulating component is not intended to be limited to those specifically presented herein. For example, selection of the particular components for use within temperature regulating sleeves generally may vary depending on the type of smoking article, the types of individual components, the desired functionality of the sleeve, and the like.

In some embodiments, the thermal regulating component 126 may be in electrical communication with the at least one control component 124 and/or the power source 104. In embodiments wherein the thermal regulating component 126 comprises multiple individual components, for example, some or all of those components may be in electrical communication with each other and with the at least one control component and the power source. As depicted in FIG. 2, for example, the dashed lines represent the electrical connection between the control component, the power source, and various components of the thermal regulating component (e.g., the overall thermal regulating component, including various components thereof, being highlighted by the box labeled 126). In such embodiments, the at least one control component may be configured to control various functionalities of the temperature regulating sleeve based on input/feedback from these one or more components forming the overall thermal regulating component 126. In some embodiments, the thermal regulating component 126 may include one or more sensors (e.g., such as one or more temperature sensors 128, one or more flow sensors 130, and combinations thereof) and one or more ventilation components 132.

In some embodiments, the thermal regulating component 126 may include one or more temperature sensors 128. In some embodiments, the one or more temperature sensors 128 may be in electrical communication with the at least one control component 124 (e.g., such that the at least one control component receives an input related to temperature produced by the one or more temperature sensors) and optionally one or more additional components within the temperature regulating sleeve. For example, the at least one control component is configured to receive temperature readings from the one or more temperature sensors. In some embodiments, the one or more temperature sensors are selectively positioned along an interior wall 123 of the outer shell 102. In some embodiments, the one or more temperature sensors can include one or more heat probes configured to be in a heat-detecting relationship with the at least a portion of the smoking article when received by the inner chamber. The one or more temperature sensors may be fully or at least partially recessed within the outer shell. In some embodiments, however, a portion of an individual temperature sensor may extend a distance inward from the outer shell (i.e., directed interiorly toward the inner chamber 106). Examples of temperature sensors and configurations thereof within smoking articles generally are described in detail in U.S. Pat. No. 10,117,460 to Sears et al. and U.S. Pat. No. 10,226,073 to Bless et al., both of which are incorporated herein by reference in their entirety.

In some embodiments, the thermal regulating component 126 may additionally, or alternatively, include one or more flow sensors 130. A "flow sensor" as used herein, generally refers to a sensor capable of measuring/sensing a rate of air flow and, a "flow" as used herein, generally refers to a flow rate of air. It should be noted that the flow being measured by the one or more flow sensors referenced herein generally refers to the rate of air flow across that sensor and more particularly between the interior wall of the outer shell and the smoking article. In some embodiments, the one or more flow sensors 130 may be in electrical communication with the at least one control component 124 (e.g., such that the at least one control component receives an input related to airflow/flow rate produced by the one or more flow sensors) and optionally one or more additional components within the temperature regulating sleeve. For example, the at least one control component can be configured to receive flow readings from the one or more flow sensors. In some embodiments, the one or more flow sensors may be selectively positioned longitudinally along an interior wall 123 of the outer shell. Examples of air flow rate sensors and configurations thereof within smoking articles generally are described in detail in U.S. Pat. No. 10,117,460 to Sears et al. and U.S. Pat. No. 10,226,073 to Bless et al., both of which are incorporated herein by reference in their entirety.

In some embodiments, the thermal regulating component 126 may include one or more ventilation components 132 in communication with the at least one control component 124 and optionally at least one or more other components within the temperature regulating sleeve. In some embodiments, the one or more ventilation components 132 each comprise an air passage 132*a*, extending from an interior wall 123 of the outer shell 102 to an outer wall 125 of the outer shell 102, and a damper 132*b* (e.g., as depicted in FIG. 3). In some embodiments, the air passage may simply be in the form of a void, or tubular cutout, or a hole extending through the entirety of the outer shell 102. For example, the linear dashed lines in FIG. 3 represent a void in the outer wall 125 and the interior wall 123 of the outer shell 102 forming an air passage 132*a*. In some embodiments, the damper 132*b* may be in the form of a gate, a flap, or a retractable component capable of temporarily blocking the air passage.

In some embodiments, the damper can be configurable between an open position allowing air flow into, or out of, the inner chamber (via the air passage) or a closed position restricting air flow into the inner chamber (via the air passage). Generally, the damper is considered to be in an open position when the air passage is at least partially open, allowing at least some air flow into the inner chamber via the air passage. For example, the damper may be configurable in an open position such that at least 10%, at least 20%, at least 30%, at least 40%, at least 50%, at least 60%, at least 70%, at least 80%, at least 90%, or substantially all (100%) of the air passage is unobstructed. In some embodiments, the percentage obstruction of the air passage may be controlled by the at least one control component based on the desired flow rate of air into, or out of, the temperature regulating sleeve. Movement of the damper 132*b* between an open position (or a partially open position) and a closed position according to an example embodiment is represented by the dashed ellipse in FIG. 3, e.g., illustrating that the damper may be rotatable along a single axis such that it can be configured to be in either open (including partially open) or closed position. Such a configuration is not meant to be limiting, for example, in some embodiments the damper may be retractable into the outer shell so as to provide a completely unobstructed air passage when the damper is 100% open.

In some embodiments, for example, the position of the damper is configured to be selectively controlled by the at least one control component based on the temperature and/or flow readings received from the one or more temperature sensors and/or the one or more flow sensors (e.g., the at least one control component is configured to receive an input related to temperature and/or airflow produced by the one or more sensors and configured to provide an output to the one or more ventilation components to effect an automatic adjustment of at least a temperature of the first portion of the smoking article). For example, if the temperature within the temperature regulating sleeve exceeds a threshold amount, the at least one control component may effect an automatic adjustment of a temperature of the first portion of the smoking article by opening one or more of the ventilation components. Likewise, if the temperature within the temperature regulating sleeve falls below a threshold amount, the at least one control component may effect an automatic adjustment of a temperature of the first portion of the smoking article by closing one or more of the ventilation components (e.g., to retain more heat within the sleeve). Adjustment and/or control of the dampers is not meant to be limited by such a control configuration and other control configurations are contemplated. For example, the operation of the damper(s) and their control configurations may vary depending on the nature of the smoking article used therewith. In certain embodiments, for example, wherein the smoking article comprises a potentially combustible material, it may be advantageous to close (at least partially) the damper(s) in order to suppress oxygen access to the combustible material. In such an embodiment, the temperature sensors would serve as indicators of nascent, unwanted combustion, for example.

The threshold temperature at which the at least one control component may effect an automatic adjustment of a temperature of the first portion of the smoking article may vary depending on the desired application of the temperature regulating sleeve. In some embodiments, for example, it may be advantageous for the threshold temperature to be approximately equal to the lowest temperature at which undesirable pyrolysis or combustion byproducts would form. Thus, the threshold temperature may vary based on the type of smoking article to be used with the temperature regulating sleeve. In some embodiments, the threshold temperature may be in the range of about 100° C. to about 300° C., or about 150° C. to about 200° C. In some embodiments, the threshold temperature may be less than 250° C., less than 225° C., less than 200° C., less than 175° C., less than 150° C., or less than 125° C.

In other embodiments, the damper may be completely, or at least partially, in the form of a heat responsive material that is activated at a predefined temperature. In such embodiments, the heat responsive material may be configured to change from a closed position to an open position (or partially open position) and vice versa when the surface temperature of the heat responsive material exceeds a threshold temperature (e.g., to effect an automatic adjustment of a temperature of the first portion of the smoking article). Example heat responsive materials that may be suitable may include, but are not limited to, heat-responsive polymer materials, heat responsive thermoplastic materials, heat responsive metallic materials, bilayer metal materials, and the like.

The threshold temperature at which the heat-responsive material is trigged may vary depending on the desired application of the temperature regulating sleeve. In some embodiments, for example, it may be advantageous for the threshold temperature to be approximately equal to the lowest temperature at which undesirable pyrolysis or combustion byproducts would form. Thus, the threshold temperature may vary based on the type of smoking article to be used with the temperature regulating sleeve. In some embodiments, the threshold temperature may be in the range of about 100° C. to about 300° C., or about 150° C. to about 200° C. In some embodiments, the threshold temperature may be less than 250° C., less than 225° C., less than 200° C., less than 175° C., less than 150° C., or less than 125° C.

In some embodiments, the heat responsive material may comprise a shape-memory material. In some embodiments, the shape-memory material may be a shape-memory alloy. In other embodiments, the shape-memory material may be a shape-memory polymer. Some descriptions of shape memory alloys can be found in U.S. Pat. No. 10,080,388 to Sebastian et al., and U.S. Pat. App. Pub. No. 2018/0174500 to Sebastian et al., which are incorporated herein by reference in their entireties. Shape-memory alloys generally refer to a group of metallic materials that demonstrate the ability to return to some previously defined shape or size when subjected to an appropriate stimulus, which may vary across various embodiments. For example, in some embodiments the stimulus may comprise a change in temperature. In other embodiments, the stimulus may comprise a change in an electric or magnetic field. In other embodiments, the stimulus may comprise exposure to light. In other embodiments, the stimulus may comprise a change in pH level. In still other embodiments, the stimulus may comprise a chemical reaction. Some shape-memory alloys are configured to change phase and/or crystal structure resulting in a shape memory effect. For example, some shape-memory alloys are capable of undergoing phase transitions in which their yield strength, stiffness, dimension and/or shape are altered as a function of temperature. Generally, in the low temperature, or martensite phase, shape memory alloys can be elastically deformed and upon exposure to some higher temperature will transform to an austenite phase, or parent phase, returning to their shape prior to the deformation. Some shape memory alloys may exhibit a one-way shape memory effect, an intrinsic two-way effect, or an extrinsic two-way shape memory effect depending on the alloy composition and processing history.

Some examples of suitable shape-memory alloy materials include, without limitation, nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-platinum based alloys, iron-palladium based alloys, and the like. The alloys can be binary, ternary, or any higher order so long as the alloy composition exhibits a shape memory effect, e.g., change in shape orientation, damping capacity, and the like. For example, in some embodiments the shape-memory alloys may comprise a composite of three elements (e.g., titanium, nickel, and copper). The transformation point can be tuned by using different combinations of the elements or changing the concentration of each element in the composite. Additional examples of shape memory materials and applications can be found, for example, in U.S. application Ser. No. 16/422,338 to Hejazi et al., filed on May 24, 2019, Shape Memory Material for Controlled Liquid Delivery in an Aerosol Delivery Device.

In some embodiments, the thermal regulating component 126 may include one or more heaters 134. In some embodiments, the one or more heaters 134 may be in electrical communication with the at least one control component 124 and optionally one or more other components within the temperature regulating sleeve. For example, the one or more heaters can be configured to be selectively controlled by the at least one control component based on the temperature and/or the flow readings received from the one or more temperature sensors and/or the one or more flow sensors (e.g., where the at least one control component is configured to receive an input related to temperature and/or airflow produced by the one or more sensors and configured to provide an output to the one or more heaters to effect an automatic adjustment of at least a temperature of the first portion of the smoking article). For example, if the temperature within the temperature regulating sleeve falls below a threshold amount, the at least one control component may effect an automatic adjustment of a temperature of the first portion of the smoking article by activating the one or more of the heaters (e.g., to apply more heat to the first portion of the smoking article). Likewise, if the temperature within the temperature regulating sleeve exceeds a threshold amount, the at least one control component may effect an automatic adjustment of a temperature of the first portion of the smoking article by shutting off one or more of the heaters. In some embodiments, the one or more heaters may be configured to be in direct contact with at least a portion of the smoking article, or the one or more heaters may not directly contact the smoking article at all. Generally, the one or more heaters can be configured to be in a heating relationship with one or more areas of the at least a portion of the smoking article when appropriately distributed along the inner chamber. In some embodiments, the one or more heaters are in the form of metallic trace heaters, which may be positioned longitudinally along the interior wall 123 of the outer shell 102.

In some embodiments, the one or more heaters may be in the form of a conductive and/or inductive heat source. Beneficially, the one or more heaters can be provided in a form that enables the one or more heaters to be positioned in intimate contact with or in close proximity to the smoking article (e.g. to provide sufficient heat to the smoking article through, for example, conduction, radiation, or convection). In various embodiments, a conductive heat source may comprise a heating assembly that comprises a resistive heating source. Resistive heating sources may be configured to produce heat when an electrical current is directed therethrough. Electrically conductive materials useful as resistive heating sources may be those having low mass, low density, and moderate resistivity and that are thermally stable at the temperatures experienced during use. Useful heating sources heat and cool rapidly, and thus provide for the efficient use of energy. Such heating sources may also permit relatively precise control of the temperature range experienced by the smoking article, especially when time based current control is employed.

Some example, non-limiting, materials that may be used as the electrically conductive material include carbon, graphite, carbon/graphite composites, metals, ceramics such as metallic and non-metallic carbides, nitrides, oxides, silicides, inter-metallic compounds, cermets, metal alloys, and metal foils. In particular, refractory materials may be useful. Various, different materials can be mixed to achieve the desired properties of resistivity, mass, and thermal conductivity. In specific embodiments, metals that can be utilized include, for example, nickel, chromium, alloys of nickel and chromium (e.g., nichrome), and steel. Materials that can be useful for providing resistive heating are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties.

As described above, the one or more heaters may be in the form of an inductive heat source. For example, in such embodiments, an inductive heat source may comprise a resonant transformer, which may comprise a resonant transmitter and a resonant receiver (i.e., a susceptor). In some embodiments, the resonant transmitters may comprise a foil material, a coil, a cylinder, or other structure configured to generate an oscillating magnetic field, and the resonant receiver may comprise one or more prongs that are configured to engage the first portion of the smoking article or may be positioned to surround the smoking article. In other embodiments, a resonant transmitter may comprise a helical coil configured to circumscribe the inner chamber in which the smoking article is received. In some embodiments, the helical coil may be positioned, for example, on the interior wall of the outer shell. Other possible inductive heat sources and components thereof, including resonant transmitters and resonant receivers, are described in U.S. patent application Ser. No. 15/799,365, filed on Oct. 31, 2017, and titled Induction Heated Aerosol Delivery Device, which is incorporated herein by reference in its entirety.

As noted above, the one or more temperature sensors may provide temperature readings to the at least one control component and the one or more flow sensors may provide flow readings to the at least one control component. Any variety of sensors and combinations thereof can be incorporated, as already described herein. Such sensors can be, for example, in direct contact with the one or more heaters and/or the one or more ventilation components. In some embodiments, for example, a regulator component, or multiple regulator components, may be provided in communication between the power source and the one or more heaters, with the regulator component being configured to selectively regulate current flow from the power source to the one or more heaters to control a temperature thereof based on output from the at least one control component. In some embodiments, the current regulating component can function to stop current flow to the resistive heating element once a defined temperature has been achieved. Alternative temperature sensing arrangements may be used, such as logic control components to evaluate a resistance of the one or more heaters and to correlate such resistance to the temperature of the one or more heaters. In other instances, the one or more heaters may be engaged with the at least one control component via a feedback loop, wherein, for example, a comparator may compare a measured electrical parameter (i.e., voltage, current) at the one or more heaters to a desired set point, and adjust the output of that electrical parameter from the power source.

As noted above, the at least one control component may be configured to receive input from multiple sensors simultaneously (e.g., related to temperature readings and/or airflow readings), all of which may be selectively positioned at various points along the interior wall of the outer shell so as to gather temperature readings and/or flow readings at various segments of the smoking article, and then the at least one control component is configured to provide an output to one or more ventilation components and/or one or more heaters to effect an automatic adjustment of at least a temperature of the smoking article. In some embodiments, for example as depicted in FIG. 4, the first portion of the smoking article 118 (same as the first portion referred to in FIG. 1) may be referred to in relation to defined segments of the first portion of the smoking article (e.g., a first segment (118*a*), a second segment (118*b*), a third segment (118*c*), a further segment (118*d*), and so on, as depicted in FIG. 4). In such embodiments, the at least one control component and the thermal regulating component (including the components thereof) can be configured to effect an automatic adjustment of the temperature of any specific segment of the first portion of the smoking article individually, or in combination (either simultaneously or consecutively) with any other segment of the first portion of the smoking article. For example, if the temperature measured by a temperature sensor positioned proximate to segment 118*a* exceeds a threshold amount, this temperature reading is communicated to the at least one control component, and then the at least one control component may effect an automatic adjustment of the temperature of segment 118*a* of the smoking article, for example, by opening one or more ventilation components (via output from the at least one control component) positioned proximate to segment 118*a*, without substantially affecting the temperature of any other segments. Likewise, if the temperature measured by a temperature sensor positioned proximate to segment 118*d* falls below a threshold amount, this temperature reading is communicated to the at least one control component, and the at least one control component may effect an automatic adjustment of the temperature of segment 118*d* of the smoking article, for example, by closing one or more ventilation components (via output from the at least one control component) positioned proximate to segment 118*d* and/or by selectively activating one or more heaters (via output from the at least one control components) positioned proximate to segment 118*d*, without substantially affecting the temperature of any other segments. It should be noted that the particular examples and embodiments described herein above are not intended to be limiting with respect to the functionality, configuration, and/or selection of components of the thermal regulating component and generally, the at least one control component and the thermal regulating component (including the components thereof) as described herein can be configured to effect an automatic adjustment of the temperature of any segment, or segments, of the smoking articles used therein (e.g., either by altering the application of heat to the smoking article (via the one or more heaters) or by altering the air flow characteristics within the sleeve (via the one or more ventilation components).

In some embodiments, the temperature regulating sleeve may be configured to harvest thermal energy that is generated within the temperature regulating sleeve and transfer such harvested energy (in the form of electrical energy) to various components within the temperature regulating sleeve. For example, in some embodiments, the one or more heaters 134 may include one or more thermoelectric generators 135 configured to store thermal energy generated within the temperature regulating sleeve and convert that stored energy into a usable electromagnetic form. A "thermoelectric generator" (TEG) as described herein, sometimes referred to as a "Seebeck generator," is a solid state device that converts heat flux (temperature differences) directly into electrical energy through a phenomenon called the Seebeck effect, a form of thermoelectric effect. Generally, the conversion of thermal energy to electrical energy (via the Seebeck effect) by the thermoelectric generator is substantially instantaneous because the thermoelectric materials in the thermoelectric generator generate power directly from the heat by converting temperature differences into electric voltage instantaneously. The one or more thermoelectric generators 135 may be in electrical communication with various other components within the thermal regulating component 126 (e.g., the one or more heaters, the power source, the at least one control component, and the like). For example, in some embodiments, the thermoelectric generator may be in electrical communication with a capacitor and/or the power source in order to supplement the principal power supply within the temperature regulating sleeve. Use of one or more thermoelectric generators within the temperature regulating sleeve may be particularly advantageous when used to supplement a traditional power supply provided within the temperature regulating sleeve, e.g., to increase the efficiency of the temperature regulating sleeve and/or reduce the overall battery capacity required.

In some embodiments, the temperature regulating sleeve may include one or more additional components. The one or more additional components may be positioned within the outer shell, positioned on the outer surface of the outer shell, or attached separately thereto. The positioning and configuration of various components within the temperature regulating sleeve may vary. For example, as depicted in FIG. 4, the temperature regulating sleeve 100 may comprise one or both of an input element 136 and a feedback element 138 on an outer surface 125 of the outer shell 102. Generally, the input element 136 and/or the feedback element 138 are in electrical communication with the at least one control component 124. The input element 136 may be included to allow a user to control one or more functions of the sleeve and/or to provide for activation or deactivation of the sleeve. Any component or combination of components may be utilized as the input element for controlling the function of the temperature regulating sleeve. For example, one or more pushbuttons may be used as described in U.S. Pub. No. 2015/0245658 to Worm et al., which is incorporated herein by reference. Likewise, a touchscreen may be used as described in U.S. patent application Ser. No. 14/643,626, filed Mar. 10, 2015, to Sears et al., which is incorporated herein by reference. As a further example, components adapted for gesture recognition based on specified movements of the temperature regulating sleeve may be used as an input. See U.S. Pub. 2016/0158782 to Henry et al., which is incorporated herein by reference. In some embodiments, for example, the temperature regulating sleeve can incorporate a sensor or detector for control of supply of electric power to one or more components in the temperature regulating sleeve (e.g., the thermal regulating component) which can be controlled and/or activated manually (e.g., via a pushbutton, a touchscreen, etc.). As such, for example, there is provided a manner or method for turning off the power supply to the temperature regulating sleeve, and specific components thereof, when not in use, and for turning on the power supply to actuate or trigger the temperature regulating sleeve, and specific components thereof, during use. The temperature regulating sleeve may, in some embodiments, incorporate an additional control mechanism for controlling the specific amount of electric power to various components of the thermal regulating component during draw.

In some embodiments, the temperature regulating sleeve may alternatively, or additionally, include a feedback element 138. Generally, the feedback element may be configured for output and/or display of information to a user. For example, the feedback element may be configured to indicate the current lifetime of the smoking article, the number of puffs taken or remaining until expiration (e.g., a visual puff counter), the total puff time or remaining puff time until expiration, warnings if the user is puffing too aggressively (e.g., alerts for overheating and underheating), varying degrees of heating (e.g., overheating or underheating) along portions of the smoking article, and the like. In some embodiments, the smoking article may require a pre-heating period prior to aerosol generation. In such embodiments, the feedback element may be configured to indicate the time remaining in the pre-heat period and/or indicate when the temperature regulating sleeve is ready for use. The feedback element may be configurable to provide a variety of interactive functions or displays to a user of that device. For example, the feedback element may comprise a display that is configured to display a heat gradient map of the amount of heat being applied to separate portions of the smoking article contained within the inner chamber of the outer shell.

In some embodiments, one or both of the input element and the feedback element may comprise a computer or computing device, such as a smartphone or tablet. In particular, the temperature regulating sleeve may be wired to the computer or other device, such as via use of a USB cord or similar protocol. In some embodiments, for example, the feedback element may be configured to send information to an electronic device via a wireless communication interface which may enable the temperature regulating sleeve to wirelessly communicate with one or more networks, computing devices or other appropriately-enabled devices. Examples of suitable computing devices include any of a number of different mobile computers. More particular examples of suitable mobile computers include portable computers (e.g., laptops, notebooks, tablet computers), mobile phones (e.g., cell phones, smartphones), wearable computers (e.g., smartwatches) and the like. In other examples, the computing device may be embodied as other than a mobile computer, such as in the manner of a desktop computer, server computer or the like. And in yet another example, the computing device may be embodied as an electric beacon such as one employing iBeacon™ technology developed by Apple Inc. Examples of suitable manners according to which the aerosol delivery device may be configured to wirelessly communicate are disclosed in U.S. patent application Ser. No. 14/327,776, filed Jul. 10, 2014, to Ampolini et al., and U.S. patent application Ser. No. 14/609,032, filed Jan. 29, 2016, to Henry, Jr. et al., each of which is incorporated herein by reference in its entirety.

The wireless communication interface may include, for example, an antenna (or multiple antennas) and supporting hardware and/or software for enabling wireless communication with a communication network (e.g., a cellular network, Wi-Fi, WLAN, and/or the like), and/or for supporting device-to-device, short-range communication, in accordance with a desired communication technology. Examples of suitable short-range communication technologies that may be supported by the communication interface include various near field communication (NFC) technologies, wireless personal area network (WPAN) technologies and the like. More particular examples of suitable WPAN technologies include those specified by IEEE 802.15 standards or otherwise, including Bluetooth, Bluetooth low energy (Bluetooth LE), ZigBee, infrared (e.g., IrDA), radio-frequency identification (RFID), Wireless USB and the like. Yet other examples of suitable short-range communication technologies include Wi-Fi Direct, as well as certain other technologies based on or specified by IEEE 802.11 and/or IEEE 802.15.4 standards and that support direct device-to-device communication.

The temperature regulating sleeve also may communicate with a computer or other device acting as an input via wireless communication. See, for example, the systems and methods for controlling a device via a read request as described in U.S. Pub. No. 2016/0007561 to Ampolini et al., the disclosure of which is incorporated herein by reference. In such embodiments, an APP or other computer program may be used in connection with a computer or other computing device to input control instructions to the temperature regulating sleeve, such control instructions including, for example, the ability to alter heating along specific portions of the smoking article (e.g., via activation of one or more heaters), the ability to increase or decrease air flow along specific portions of the smoking article (e.g., via activation of one or more ventilation components), choosing the total particulate matter (TPM) provided per puff, choosing a specific heating profile to be implemented, choosing a modifiable resistance to draw, and the like.

In some embodiments, the temperature regulating sleeve may include one or more visual indicators or elements. In some embodiments, the visual indicator or element can be configured to perform a variety of functions, for example, to indicate an on/off status of the sleeve, to indicate a charging status and/or battery life, etc. One example of a suitable component is an indicator such as light-emitting diodes (LEDs), quantum dot-based LEDs or the like, which may be illuminated with use of the temperature regulating sleeve.

Examples of suitable LED components, and the configurations and uses thereof, are described in U.S. Pat. No. 5,154,192 to Sprinkel et al.; U.S. Pat. No. 8,499,766 to Newton; U.S. Pat. No. 8,539,959 to Scatterday; and U.S. Pat. No. 9,451,791 to Sears et al., all of which are incorporated herein by reference. Further indicators (e.g., a haptic feedback component, an audio feedback component, or the like) can be included in addition to or as an alternative to the LED. Additional representative types of components that yield visual cues or indicators, such as light emitting diode (LED) components, and the configurations and uses thereof, are described in U.S. Pat. No. 5,154,192 to Sprinkel et al.; U.S. Pat. No. 8,499,766 to Newton and U.S. Pat. No. 8,539,959 to Scatterday; U.S. Pat. Pub. No. 2015/0020825 to Galloway et al.; and U.S. Pat. Pub. No. 2015/0216233 to Sears et al.; which are incorporated herein by reference. It is understood that not all of the illustrated elements are required. For example, an LED may be absent or may be replaced with a different indicator, such as a vibrating indicator.

Yet other components are also contemplated, particularly those suitable for use with aerosol delivery devices may be incorporated into the temperature regulating sleeves of the present disclosure. For example, U.S. Pat. No. 5,154,192 to Sprinkel et al. discloses indicators for smoking articles; U.S. Pat. No. 5,261,424 to Sprinkel, Jr. discloses piezoelectric sensors that can be associated with the mouth-end of a device to detect user lip activity associated with taking a draw and then trigger heating of a heating device; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; U.S. Pat. No. 8,402,976 to Fernando et al. discloses computer interfacing means for smoking devices to facilitate charging and allow computer control of the device; U.S. Pat. No. 8,689,804 to Fernando et al. discloses identification systems for smoking devices; and PCT Pat. App. Pub. No. WO 2010/003480 by Flick discloses a fluid flow sensing system indicative of a puff in an aerosol generating system; all of the foregoing disclosures being incorporated herein by reference.

In some embodiments, the temperature regulating sleeve 100 may further comprise a mouthpiece 140 engaged with the first opening 110 of the outer shell 102 and arranged to interact with a mouth end 114 of the smoking article (e.g., as depicted in FIG. 4). In some embodiments, the mouthpiece defines a channel 142 in fluid communication with the first opening of the outer shell such that a draw applied to the mouthpiece is communicated to the smoking article. The mouthpiece may be connected to the outer shell via various different mechanisms, for example, a screw-fit engagement, a press-fit engagement, a snap-fit engagement, a magnetic engagement, and the like. Generally, the mouthpiece may be removable and/or replaceable. While the power source 104 and the control component 124 are positioned between the smoking article and the mouthpiece 140 in the depicted embodiment, it should be noted that other configurations are possible. For example, the power source 104 and/or the control component 124 may be embedded elsewhere in the outer shell 102 of the temperature regulating sleeve. In some embodiments, for example, the power source and/or the control component may be positioned within or embedded in the outer shell and proximate to the smoking article.

In some embodiments, the temperature regulating sleeve may further comprise one or more porous structures 144 positioned within the outer shell 102 and arranged relative to the first opening 110 in the outer shell 102 such that the aerosol exiting through the opening passes one or both of through and around the one or more porous structures 144. In other embodiments, one or more porous structures may be positioned entirely, or at least partially, within the mouthpiece 140 (not pictured). In some embodiments, the aerosol generated by the smoking article when a user draws on the temperature regulating sleeve may flow through and/or around the one or more porous structures. In some embodiments, for example, the porous structure may be in the form of a filter or a porous material configured to contain a liquid material suitable for transferring one or more flavors or other components (e.g., such as an active ingredient) to the aerosol passing therethrough. In some embodiments, the porous structure may provide filtering capacity, if desired, and/or provide resistance to draw. In some embodiments, the filter may comprise discrete segments. For example, some embodiments may include a segment providing filtering, a segment providing draw resistance, a hollow segment providing a space for the aerosol to cool, a segment providing increased structural integrity, other filter segments, and any one or any combination of the above. In other embodiments, the mouthpiece 140, itself, may include a chamber or void therein (downstream of the smoking article) that may be sized and/or shaped to provide for appropriate condensation and/or cooling of aerosol before drawn into the mouth of a user of the temperature regulating sleeve. In such embodiments, the chamber or void may contain a porous structure as discussed herein above to provide one or more of filtering capacity, cooling, and/or draw resistance.

Generally, the porous structure may be provided in a variety of forms including various different components therein. In some embodiments, for example, the porous structure may comprise one or more of an air gap, a hollow tube structure, phase change materials for cooling air, flavor releasing media, ion exchange fibers capable of selective chemical adsorption, aerogel particles as filter medium, and other suitable materials. Some examples of possible phase change materials include, but are not limited to, salts, such as $AgNO_3$, $AlCl_3$, $TaCl_3$, $InCl_3$, $SnCl_2$, $AlI_3$, and $TiI_4$; metals and metal alloys such as selenium, tin, indium, tin-zinc, indium-zinc, or indium-bismuth; and organic compounds such as D-mannitol, succinic acid, p-nitrobenzoic acid, hydroquinone and adipic acid. Other examples are described in U.S. Pat. No. 8,430,106 to Potter et al., which is incorporated herein by reference in its entirety. The porous structure may be formed of various different materials, for example, in some embodiments the porous structure may be made of a cellulose acetate or polypropylene material. Generally, any porous filter materials commonly used in the art would be suitable for forming the porous structure.

In some embodiments, the porous structure may be configured to release a second aerosol when heated that can combine with aerosol released from the smoking article during use of the temperature regulating sleeve. In such embodiments, the porous structure may be configured to contain a non-tobacco flavored liquid (e.g., such as a nicotine solution), a tobacco extract or distillate, a flavoring agent, an aerosol precursor composition, and combinations thereof. In some embodiments, for example, the porous structure may be configured to be heated by a heater within the outer shell (e.g., such as one of the one or more heaters described herein above), thus producing an aerosol. Any heater as defined herein above may be suitable for heating the porous structure. In such embodiments, heating of the porous structure can generate an aerosol that can combine with the aerosol generated by the smoking article during use of the temperature regulating sleeve.

Some aerosol precursor compositions that may be used in conjunction with the porous structure may include one or more acids such as levulinic acid, succinic acid, lactic acid, pyruvic acid, benzoic acid, fumaric acid, combinations thereof, and the like. Inclusion of an acid(s) in liquid aerosol precursor compositions including nicotine may provide a protonated liquid aerosol precursor composition, including nicotine in salt form. In some embodiments, the aerosol precursor composition may comprise a variety of components including, by way of example, a polyhydric alcohol (e.g., glycerin, propylene glycol, or a mixture thereof), nicotine, tobacco, tobacco extract, and/or flavorants. In some examples, the aerosol precursor composition comprises glycerin and nicotine. Representative types of liquid aerosol precursor components and formulations are set forth and characterized in U.S. Pat. No. 7,726,320 to Robinson et al., U.S. Pat. No. 9,254,002 to Chong et al., and U.S. Pat. App. Pub. Nos. 2013/0008457 to Zheng et al., 2015/0020823 to Lipowicz et al., and 2015/0020830 to Koller, as well as PCT Pat. App. Pub. No. WO 2014/182736 to Bowen et al., and U.S. Pat. No. 8,881,737 to Collett et al., the disclosures of which are incorporated herein by reference. Other aerosol precursors that may be employed include the aerosol precursors that have been incorporated in any of a number of the representative products identified above. Also desirable are the so-called "smoke juices" for electronic cigarettes that have been available from Johnson Creek Enterprises LLC. Still further example aerosol precursor compositions are sold under the brand names BLACK NOTE, COSMIC FOG, THE MILKMAN E-LIQUID, FIVE PAWNS, THE VAPOR CHEF, VAPE WILD, BOOSTED, THE STEAM FACTORY, MECH SAUCE, CASEY JONES MAINLINE RESERVE, MITTEN VAPORS, DR. CRIMMY'S V-LIQUID, SMILEY E LIQUID, BEANTOWN VAPOR, CUTTWOOD, CYCLOPS VAPOR, SICBOY, GOOD LIFE VAPOR, TELEOS, PINUP VAPORS, SPACE JAM, MT. BAKER VAPOR, and JIMMY THE JUICE MAN. Implementations of effervescent materials can be used with the aerosol precursor, and are described, by way of example, in U.S. Pat. App. Pub. No. 2012/0055494 to Hunt et al., which is incorporated herein by reference. Further, the use of effervescent materials is described, for example, in U.S. Pat. No. 4,639,368 to Niazi et al., U.S. Pat. No. 5,178,878 to Wehling et al., U.S. Pat. No. 5,223,264 to Wehling et al., U.S. Pat. No. 6,974,590 to Pather et al., U.S. Pat. No. 7,381,667 to Bergquist et al., U.S. Pat. No. 8,424,541 to Crawford et al, U.S. Pat. No. 8,627,828 to Strickland et al., and U.S. Pat. No. 9,307,787 to Sun et al., as well as U.S. Pat. App. Pub. Nos. 2010/0018539 to Brinkley et al., and PCT Pat. App. Pub. No. WO 97/06786 to Johnson et al., all of which are incorporated by reference herein.

As noted above, the one or more porous structures may additionally or alternatively include other active ingredients including, but not limited to, a nicotine component, botanical ingredients (e.g., lavender, peppermint, chamomile, basil, rosemary, ginger, cannabis, ginseng, maca, hemp, eucalyptus, rooibos, fennel, citrus, cloves, and tisanes), stimulants (e.g., caffeine and guarana), amino acids (e.g., taurine, theanine, phenylalanine, tyrosine, and tryptophan) and/or pharmaceutical, nutraceutical, medicinal ingredients (e.g., vitamins, such as B6, B12, and C, and/or cannabinoids, such as tetrahydrocannabinol (THC) and cannabidiol (CBD)).

As used herein, a "flavoring agent" or "flavorant" refers to compounds or components that can be aerosolized and delivered to a user and which impart a sensory experience in terms of taste and/or aroma. Non-limiting examples of flavoring agents can include, but are not limited to, vanilla, coffee, chocolate/cocoa, cream, mint, spearmint, menthol, peppermint, wintergreen, eucalyptus, lavender, cardamon, nutmeg, cinnamon, clove, cascarilla, sandalwood, honey, jasmine, ginger, anise, sage, licorice, lemon, orange, apple, peach, lime, cherry, strawberry, terpenes, trigeminal senstates, and any combinations thereof. See also, Leffingwell et al., Tobacco Flavoring for Smoking Products, R. J. Reynolds Tobacco Company (1972), which is incorporated herein by reference. Flavorings also may include components that are considered moistening, cooling or smoothening agents, such as eucalyptus. These flavors may be provided neat (i.e., alone) or in a composite, and may be employed as concentrates or flavor packages (e.g., spearmint and menthol, orange and cinnamon; lime, pineapple, and the like). Representative types of components also are set forth in U.S. Pat. No. 5,387,416 to White et al.; US Pat. App. Pub. No. 2005/0244521 to Strickland et al.; and PCT Application Pub. No. WO 05/041699 to Quinter et al., each of which is incorporated herein by reference. In some instances, the flavoring agent may be provided in a spray-dried form or a liquid form.

The flavoring agent may be a volatile flavor component. As used herein, "volatile" refers to a chemical substance that forms a vapor readily at ambient temperatures (i.e., a chemical substance that has a relatively high vapor pressure at a given temperature relative to a nonvolatile substance). Typically, a volatile flavor component has a molecular weight below about 400 Da, and often includes at least one carbon-carbon double bond, carbon-oxygen double bond, or both. In one embodiment, the at least one volatile flavor component comprises one or more alcohols, aldehydes, aromatic hydrocarbons, ketones, esters, terpenes, terpenoids, or a combination thereof. Non-limiting examples of aldehydes include vanillin, ethyl vanillin, p-anisaldehyde, hexanal, furfural, isovaleraldehyde, cuminaldehyde, benzaldehyde, and citronellal. Non-limiting examples of ketones include 1-hydroxy-2-propanone and 2-hydroxy-3-methyl-2-cyclopentenone-1-one. Non-limiting examples of esters include allyl hexanoate, ethyl heptanoate, ethyl hexanoate, isoamyl acetate, and 3-methylbutyl acetate. Non-limiting examples of terpenes include sabinene, limonene, gamma-terpinene, beta-farnesene, nerolidol, thujone, myrcene, geraniol, nerol, citronellol, linalool, and eucalyptol. In one embodiment, the at least one volatile flavor component comprises one or more of ethyl vanillin, cinnamaldehyde, sabinene, limonene, gamma-terpinene, beta-farnesene, or citral. In one embodiment, the at least one volatile flavor component comprises ethyl vanillin.

In still further embodiments, the temperature regulating sleeve 100 may comprise a barrier or a sealing component 146 positioned proximate the second opening 112 in the outer shell 102 and configured to restrict air flow into the temperature regulating sleeve. In particular, the barrier or sealing component 146 may create a non-air permeable barrier and/or seal surrounding the smoking article at the intersecting plane 148 of the second portion of the smoking article 120 (e.g., containing the heat source) and the first portion of the smoking article 118 (e.g., containing a substrate material for combustion). In such embodiments, the heat source may be in the form of a substantially non-air permeable heat source such that ambient air is prevented from passing through the heat source. Likewise, the barrier or sealing component 146 prevents air from flowing around the heat source and entering the temperature regulating sleeve through the second opening 112 thereof. In some embodiments, the first portion of the smoking article 118 may comprise an air permeable wrapper and/or air inlets therein (not pictured) which are in communication with the one or more ventilation components 132 to allow air flow into the temperature regulating sleeve, via the ventilation components, to be communicated to the first portion of the smoking article during use of the temperature regulating sleeve.

In certain embodiments, the smoking article itself may include a barrier or sealing component therein which separates the second portion of the smoking article 120 (e.g., containing the heat source) and the first portion of the smoking article 118 (e.g., containing a substrate material for combustion). In such embodiments, the barrier or sealing component within the smoking article may prevent air from flowing through the heat source in the second portion of the smoking article 120 and into the first portion of the smoking article 118 position downstream therefrom. In some embodiments, the first portion of the smoking article 118 may comprise an air permeable wrapper and/or air inlets therein (not pictured) which are in communication with the one or more ventilation components 132 to allow air flow into the temperature regulating sleeve, via the ventilation components, to be communicated to the first portion of the smoking article during use of the temperature regulating sleeve.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. A temperature regulating sleeve for a smoking article, the temperature regulating sleeve comprising:

an outer shell;

an inner chamber at least partially defined within the outer shell and configured to receive at least a portion of a smoking article;

an opening through the outer shell configured for egress of an aerosol therethrough;

a power source positioned within the outer shell;

at least one control component positioned within the outer shell;

one or more temperature sensors and one or more flow sensors positioned in communication with the inner chamber, wherein the one or more temperature sensors and the one or more flow sensors are selectively positioned along an interior wall of the outer shell; and one or more ventilation components positioned in communication with the inner chamber;

wherein the at least one control component is configured to receive one or more inputs produced by the one or more temperature sensors and the one or more flow sensors, the one or more inputs being related to a temperature within the inner chamber and an airflow in the inner chamber; and wherein the at least one control component is configured to provide an output to the one or more ventilation components to effect automatic adjustment of at least a temperature of at least a portion of the smoking article.

2. The temperature regulating sleeve of claim 1, wherein the outer shell comprises a thermally-insulating material.

3. The temperature regulating sleeve of claim 2, wherein the thermally-insulating material is a ceramic material, a plastic material, a carbonaceous material, or a combination thereof.

4. The temperature regulating sleeve of claim 1, wherein the at least one control component, the one or more temperature sensors, the one or more flow sensors, and the one or more ventilation components are in electrical communication.

5. The temperature regulating sleeve of claim 1, wherein the one or more ventilation components each comprises an air passage extending through the outer shell and a damper, wherein the damper is configurable between an open position allowing air flow into the inner chamber and a closed position restricting air flow into the inner chamber.

6. The temperature regulating sleeve of claim 5, wherein the position of the damper is configured to be selectively controlled by the at least one control component.

7. The temperature regulating sleeve of claim 5, wherein the damper includes a heat-responsive material.

8. The temperature regulating sleeve of claim 7, wherein the heat responsive material is configured to spontaneously change between a closed position and an at least partially open position at approximately a chosen threshold temperature.

9. The temperature regulating sleeve of claim 1, wherein the one or more temperature sensors include one or more heat probes configured to be in a heat-detecting relationship with the at least a portion of the smoking article when received by the inner chamber.

10. The temperature regulating sleeve of claim 1, further comprising one or more heaters in electrical communication with the at least one control component.

11. The temperature regulating sleeve of claim 10, wherein the one or more heaters are configured to be selectively activated by the at least one control component.

12. The temperature regulating sleeve of claim 10, wherein the one or more heaters are configured to be in a heating relationship with one or more areas of the at least a portion of the smoking article when received by the inner chamber.

13. The temperature regulating sleeve of claim 10, wherein the one or more heaters include one or more thermoelectric generators.

14. The temperature regulating sleeve of claim 1, further comprising one or more porous structures positioned within the outer shell and arranged relative to the opening in the outer shell such that the aerosol exiting through the opening passes one or both of through and around the one or more porous structures.

15. The temperature regulating sleeve of claim 14, wherein the one or more porous structures is configured to contain at least one of a non-tobacco flavored liquid, a tobacco extract or distillate, a flavoring agent, and an aerosol precursor composition.

16. The temperature regulating sleeve of claim 1, wherein the power source comprises one or both of a battery and a capacitor.

17. The temperature regulating sleeve of claim 1, further comprising an input element positioned on an outer surface of the outer shell.

18. The temperature regulating sleeve of claim 17, wherein the input element is configured to one or both of control the supply of electric power from the power source to one or more components of the temperature regulating sleeve and control activation and deactivation of the temperature regulating sleeve.

19. The temperature regulating sleeve of claim 1, further comprising a feedback element positioned on an outer surface of the outer shell.

20. The temperature regulating sleeve of claim 19, wherein the feedback element is configured to provide one or more of feedback related to a number of puffs taken or remaining until expiration, a total puff time, a heat map showing a temperature gradient at various positions along the smoking article, and alerts for overheating and underheating at various positions along the smoking article.

* * * * *